US008047797B2

(12) United States Patent
Cosi

(10) Patent No.: US 8,047,797 B2
(45) Date of Patent: Nov. 1, 2011

(54) STEAM TURBINE AND ROTATING BLADE

(75) Inventor: Lorenzo Cosi, Florence (IT)

(73) Assignee: Nuovo Pignone Holdings, S.p.A., Florence (IT)

( * ) Notice: Subject to any disclaimer, the term of this patent is extended or adjusted under 35 U.S.C. 154(b) by 1141 days.

(21) Appl. No.: 11/778,166

(22) Filed: Jul. 16, 2007

(65) Prior Publication Data

US 2009/0022595 A1 Jan. 22, 2009

(51) Int. Cl.
*F01D 5/30* (2006.01)

(52) U.S. Cl. ..... 416/219 R; 416/248

(58) Field of Classification Search ..... 416/215, 416/216, 217, 218, 219 R, 220 R, 221, 248
See application file for complete search history.

(56) References Cited

U.S. PATENT DOCUMENTS

| | | | | |
|---|---|---|---|---|
| 2,753,149 | A * | 7/1956 | Kurti | 416/216 |
| 4,191,509 | A * | 3/1980 | Leonardi | 416/219 R |
| 4,824,328 | A * | 4/1989 | Pisz et al. | 416/219 R |
| 5,147,180 | A * | 9/1992 | Johnson | 416/219 R |
| 5,480,285 | A | 1/1996 | Patel et al. | |
| 5,554,005 | A * | 9/1996 | Nguyen | 416/219 R |
| 6,575,700 | B2 | 6/2003 | Arai et al. | |
| 7,794,208 | B2 * | 9/2010 | Suzuki et al. | 416/219 R |

* cited by examiner

*Primary Examiner* — Igor Kershteyn
(74) *Attorney, Agent, or Firm* — Nixon & Vanderhye P.C.

(57) ABSTRACT

A blade is mountable to a disc. The blade comprises a blade platform and a blade root extending from the blade platform. The blade root comprises a first hook and a second hook, a first neck between the first hook and the blade platform, and a second neck between the first hook and the second hook. Each hook comprises a contact surface and a non-contact surface. An angle between each contact surface and each non-contact surface is optimized to reduce local stresses.

16 Claims, 6 Drawing Sheets

STEAM TURBINE AND ROTATING BLADE

BACKGROUND OF THE INVENTION

The present invention relates to a rotating blade for a steam turbine and, more particularly, to an attachment arrangement for attaching a blade of a steam turbine to a rotor that minimizes local and average stresses.

The steam flow path of a steam turbine is formed by a stationary cylinder and a rotor. A number of stationary vanes are attached to the cylinder in a circumferential array and extend inward into the steam flow path. Similarly, a number of rotating blades are attached to the rotor in a circumferential array and extend outward into the steam flow path. The stationary vanes and rotating blades are arranged in alternating rows so that a row of vanes and the immediately downstream row of blades form a stage. The vanes serve to direct the flow of steam so that it enters the downstream row of blades at the correct angle. The blade airfoils extract energy from the steam, thereby developing the power necessary to drive the rotor and the load attached to it.

The blade airfoils extend from a blade root used to secure the blade to the rotor. Conventionally, this is accomplished by imparting a fir tree shape to the root by forming approximately axially extending alternating tangs and grooves along the sides of the blade root. Slots having mating tangs and grooves are formed in the rotor disc. When the blade root is slid into the disc slot, the centrifugal load on the blade, which is very high due to the high rotational speed of the rotor—typically 3600 rpm for a steam turbine employed in electrical power generation, is distributed along portions of the tangs over which the root and disc are in contact. Because of the high centrifugal loading, the stresses in the blade root and disc slot are very high. It is desirable, therefore, to minimize the stress concentrations formed by the tangs and grooves and maximize the bearing areas over which the contact forces between the blade root and disc slot occur. This is especially desirable in the latter rows of a low pressure steam turbine due to the large size and weight of the blades in these rows and the presence of stress corrosion due to moisture in the steam flow. The latter stages experience higher local stresses that may lead to lower fatigue life of the rotor and the rotating blades. There is also an increasing demand for longer rotating blades, which requires the rotor and blades to operate under even higher loads.

In addition to the steady centrifugal loading, the blades are also subject to vibration.

It is therefore desirable to provide a rotor and blade attachment configuration that has centrifugal load carrying capability, reduced local stresses on the rotor (wheel) and the fillets of the rotating blades, while maintaining average and shear stresses low.

BRIEF DESCRIPTION OF THE INVENTION

In one embodiment of the invention, a blade is mountable to a disc. The blade comprises a blade platform and a blade root extending from the blade platform. The blade root comprises a first hook and a second hook, a first neck between the first hook and the blade platform, and a second neck between the first hook and the second hook. Each hook comprises a contact surface and a non-contact surface and an angle between each contact surface and each non-contact surface is optimized to reduce local stresses.

In another embodiment of the invention, a blade is mountable to a disc. The blade comprises a blade platform and a blade root extending from the blade platform. The blade root comprises a first hook and a second hook, a first neck between the first hook and the blade platform, and a second neck between the first hook and the second hook. Each hook comprises a contact surface and a non-contact surface and an angle between each contact surface and each non-contact surface is about 80.5°.

In a further embodiment of the invention, a turbine comprises a turbine blade. The turbine blade comprises a blade platform and a blade root extending from the blade platform. The blade root comprises a first blade hook and a second blade hook, a first blade neck between the first blade hook and the blade platform, and a second blade neck between the first blade hook and the second blade hook. Each blade hook comprises a contact surface, a non-contact surface, and an angle between each contact surface and each non-contact surface. The turbine further comprises a rotor disc comprising a slot. The slot comprises a first rotor hook and a second rotor hook, a first rotor neck and a second rotor neck. Each rotor hook comprises a contact surface in contact with a corresponding contact surface of the blade and a non-contact surface spaced from a corresponding non-contact surface of the blade. The rotor contact surfaces are angled from the rotor non-contact surface at the same angle as the angle between the blade contact surfaces and the blade non-contact surfaces. The angle is optimized to reduce local and average stresses between the contact surfaces.

DETAILED DESCRIPTION OF THE INVENTION

Figure 1:
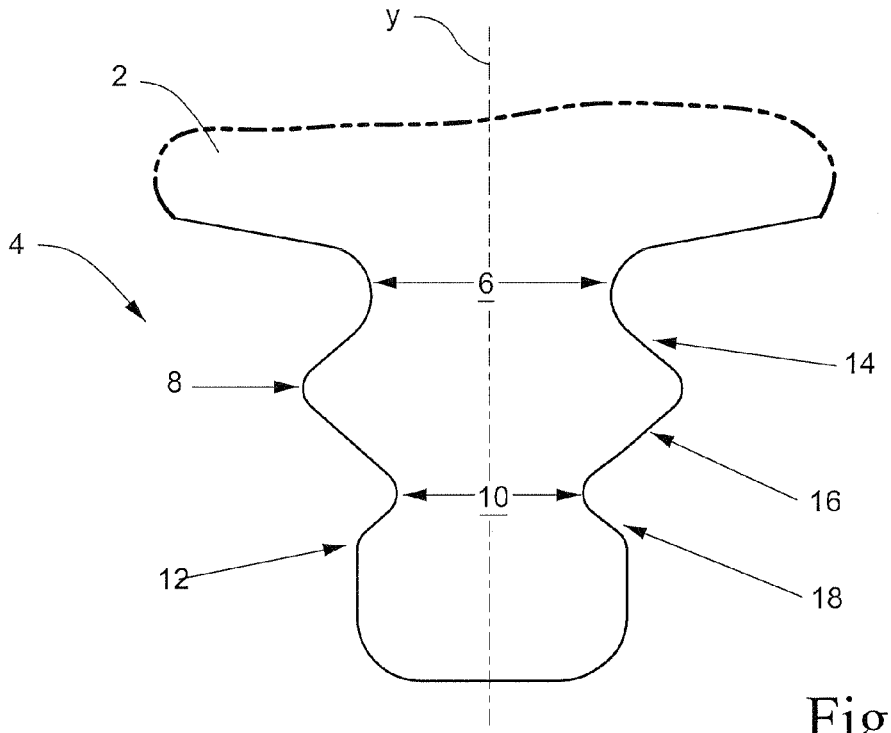
FIG. 1 is a side view of a steam turbine rotating blade including a blade root, or bucket dovetail.

Referring to FIG. 1, a steam turbine rotating blade 2 includes a blade root 4. The blade root 4 may also be referred to as a male dovetail or a bucket dovetail. The bucket dovetail 4 is symmetrical about a dovetail centerline Y. The bucket dovetail 4 comprises a top dovetail neck 6 and a bottom dovetail neck 10. A top hook 8 is provided between the top dovetail neck 6 and the bottom dovetail neck 10. The bucket dovetail 4 further comprises a bottom hook 12 below the bottom dovetail neck 10. The necks may also be referred to as grooves and the hooks may also be referred to as tangs.

The top dovetail neck 6 includes a top slanted contact, or crush, surface 14. A non-contact surface 16 is provided between the top hook 8 and the bottom dovetail neck 10. A bottom slanted contact, or crush, surface 18 is provided on the bottom hook 12.

Figure 2:
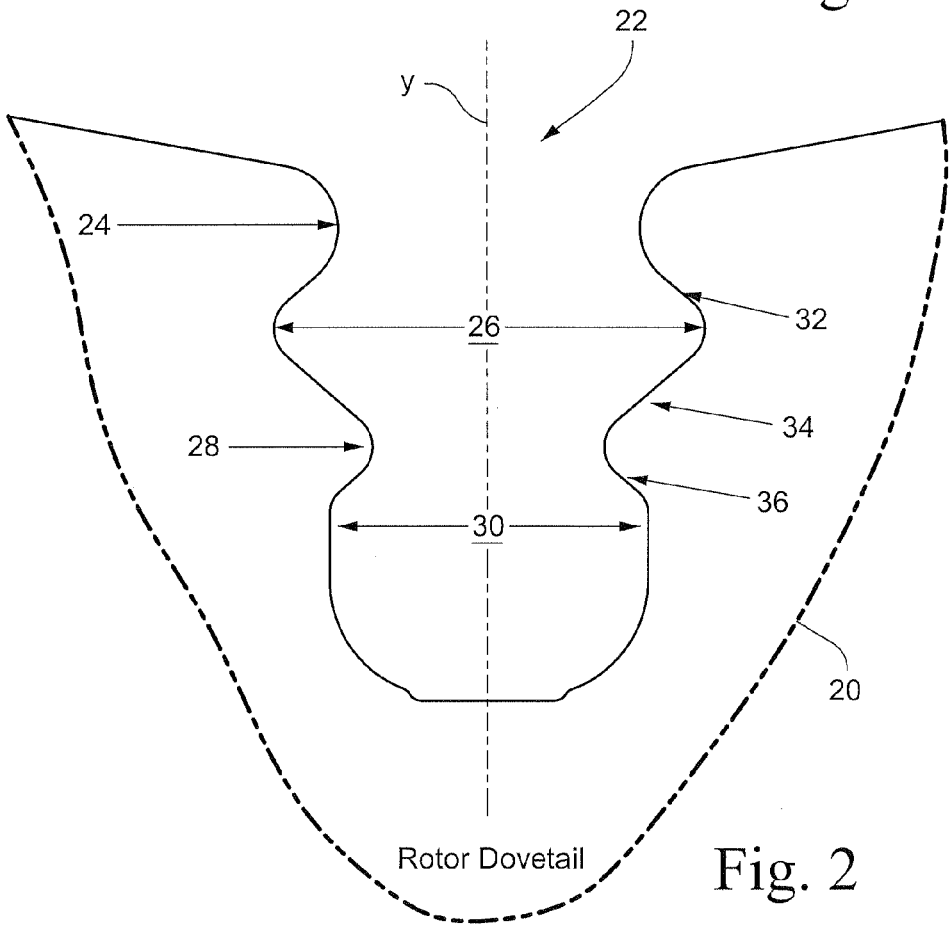
FIG. 2 is a side view of a rotor wheel of the steam turbine including a slot for the blade root.

As shown in FIG. 2, the rotor disc 20 comprises a slot, or rotor dovetail 22. The rotor dovetail 22 may also be referred to as a female dovetail or a wheel dovetail. The rotor dovetail 22 is also symmetric about the dovetail centerline Y. The rotor dovetail 22 comprises a top hook 24 and a top dovetail neck 26. The top dovetail neck 26 is followed by a bottom hook 28 which is followed by a bottom dovetail neck 30.

A top slanted contact, or crush, surface 32 is provided on the top dovetail neck 26. A non-contact surface 34 is provided on the bottom hook 28. A bottom slanted contact, or crush, surface 36 is provided on the bottom dovetail neck 30.

Figure 3:
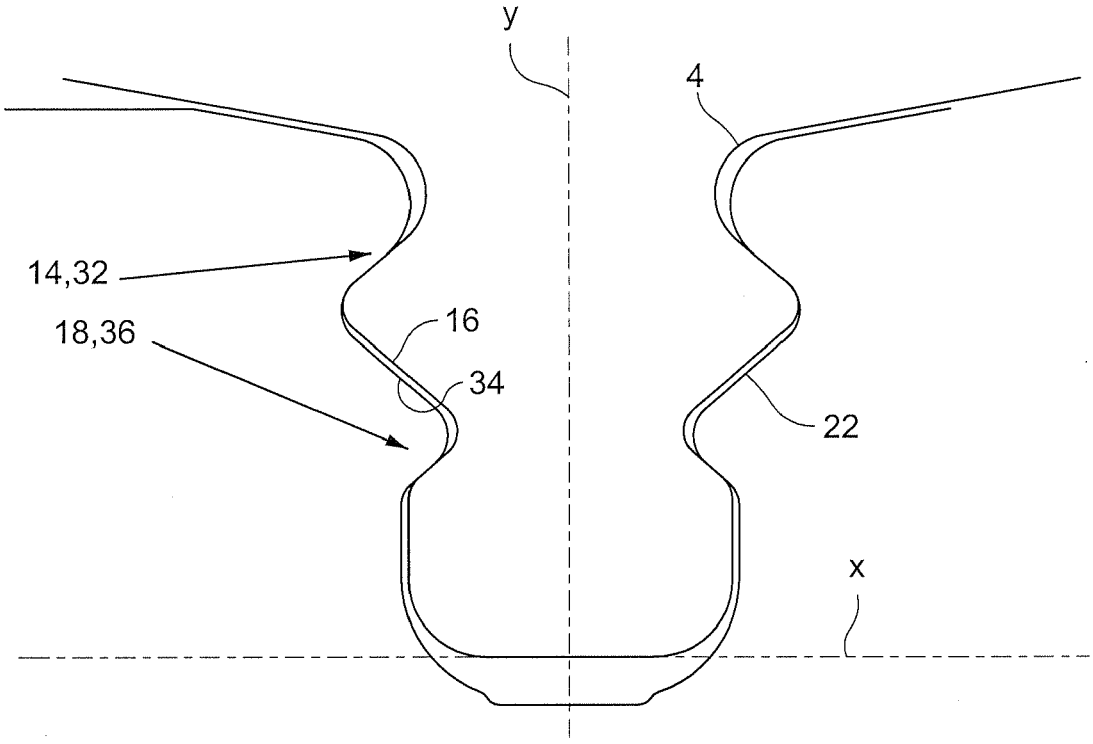
FIG. 3 is a side view of the assembled blade and rotor.

Referring to FIG. 3, the bucket dovetail 4 is assembled to the rotor disc 20 by sliding the bucket dovetail 4 into the rotor dovetail 22 in a direction perpendicular to the dovetail centerline Y, i.e. along an axis perpendicular to the plane of the drawing figure. In the assembled condition, the top slanted crush surface 14 of the blade root 4 contacts the top slanted crush surface 32 of the rotor dovetail 22. The bottom slanted crush surface 18 of the blade root 4 contacts the bottom slanted crush surface 36 of the rotor dovetail 22. The non-contact surface 16 of the blade root 4 opposes the non-contact surface 34 of the rotor dovetail 22, but as shown in FIG. 3 the surfaces do not contact one another.

Figure 10:
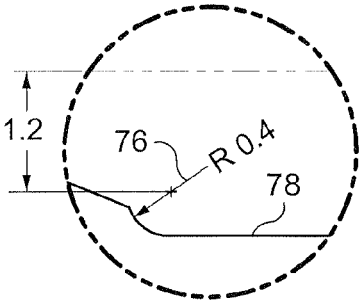
FIG. 10 shows Detail E of FIG. 4.

Referring to FIGS. 4 and 8-10, the top dovetail neck 26 of the rotor dovetail 22 comprises a rotor top neck fillet radius 38. The rotor top neck fillet radius 38 comprises a single radius. The bottom dovetail neck 30 of the rotor dovetail 22 comprises a bottom neck fillet radius. The rotor bottom neck fillet radius comprises a first fillet radius 40 and a second fillet radius 42 joined by a vertical surface 44. As shown in FIG. 10, the bottom dovetail neck 30 of the rotor dovetail 22 comprises a third fillet radius 76 that transitions to a flat surface 78 on the bottom dovetail neck 30.

The top hook 24 of the rotor dovetail 22 comprises a rotor top hook fillet radius 46. The bottom hook 28 of the rotor dovetail 22 has a bottom hook fillet radius that comprises a first fillet radius 48 and a second fillet radius 50 joined by a flat surface 52. The rotor top hook fillet radius 46 is larger than the rotor bottom hook first and second fillet radiuses 48, 50 and provides for a smooth transition with the top rotor surface 54.

Figure 5:
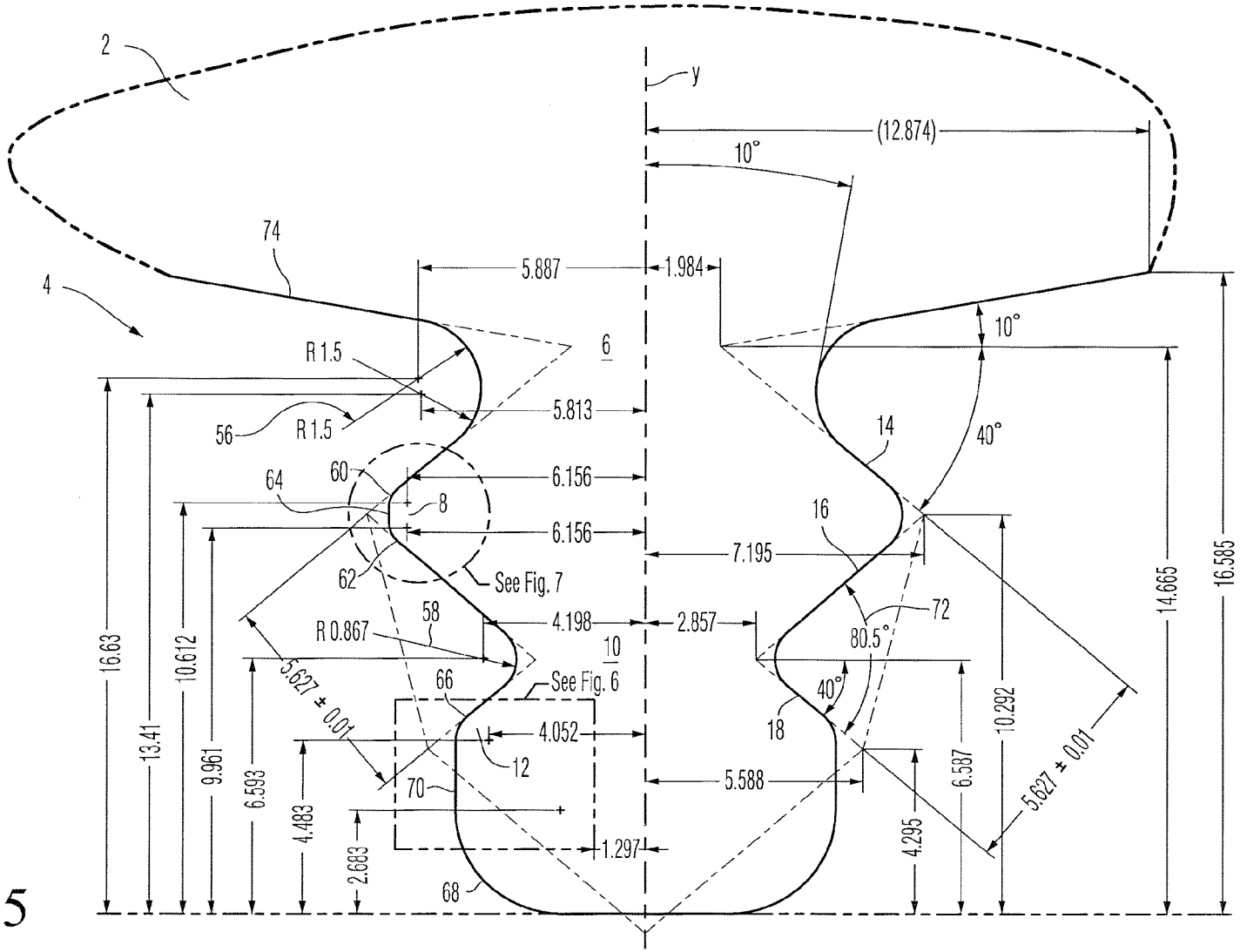
FIG. 5 is a detailed side view of the blade, including the blade root.
Figure 6:
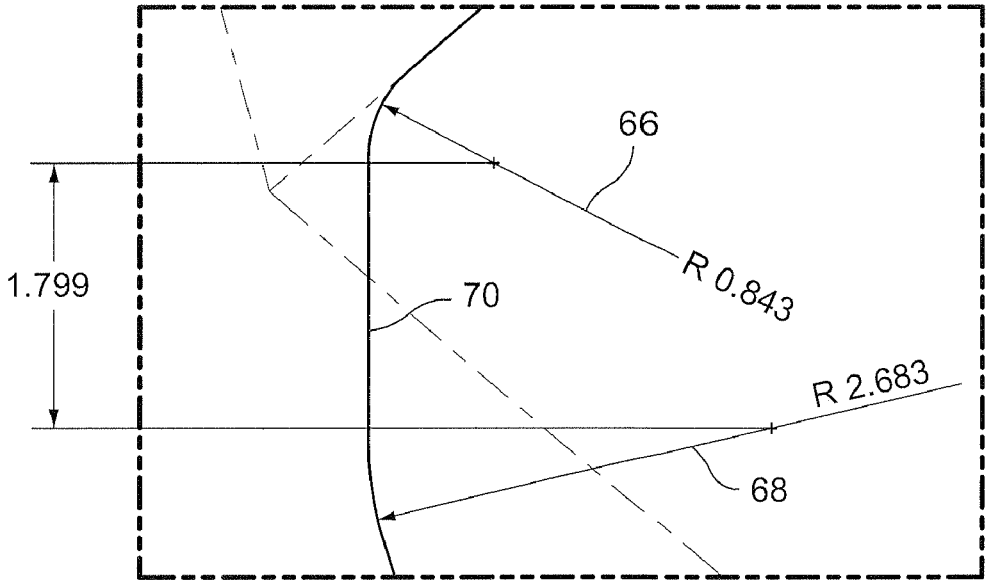
FIG. 6 shows Detail A of FIG. 5.
Figure 7:
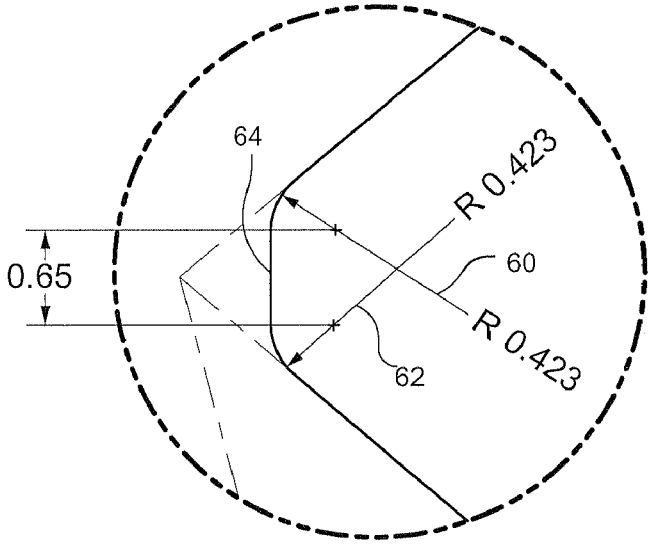
FIG. 7 shows Detail B of FIG. 5.
Figure 8:
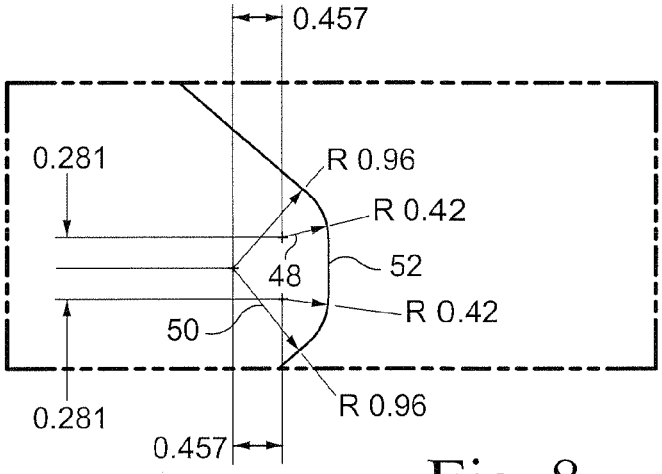
FIG. 8 shows Detail C of FIG. 4.
Figure 9:
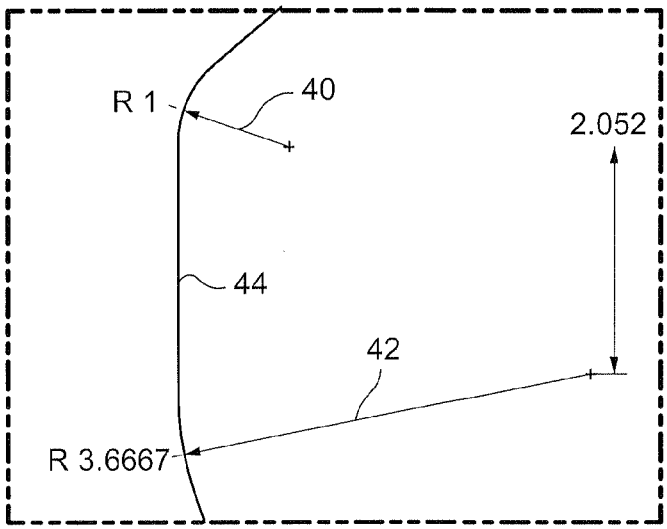
FIG. 9 shows Detail D of FIG. 4.

As shown in FIG. 5-7, the top dovetail neck 6 of the bucket dovetail 4 comprises a single fillet radius 56. The bottom dovetail neck 10 of the blade root 4 comprises a single fillet radius 58. The bucket top neck fillet radius 56 is larger than the bucket bottom neck fillet radius 58 and provides a smooth transition to a bucket dovetail platform 74. The bucket top neck fillet radius and the bucket bottom neck fillet radius 58 are optimized to reduce local stress concentration.

The top hook of the bucket dovetail 4 comprises a first fillet radius 60 and a second fillet radius 62 joined by a flat surface 64. The bottom hook 12 comprises a compound radius comprising a first fillet radius 66 and a second fillet radius 68 joined by a flat surface 70.

Figure 4:
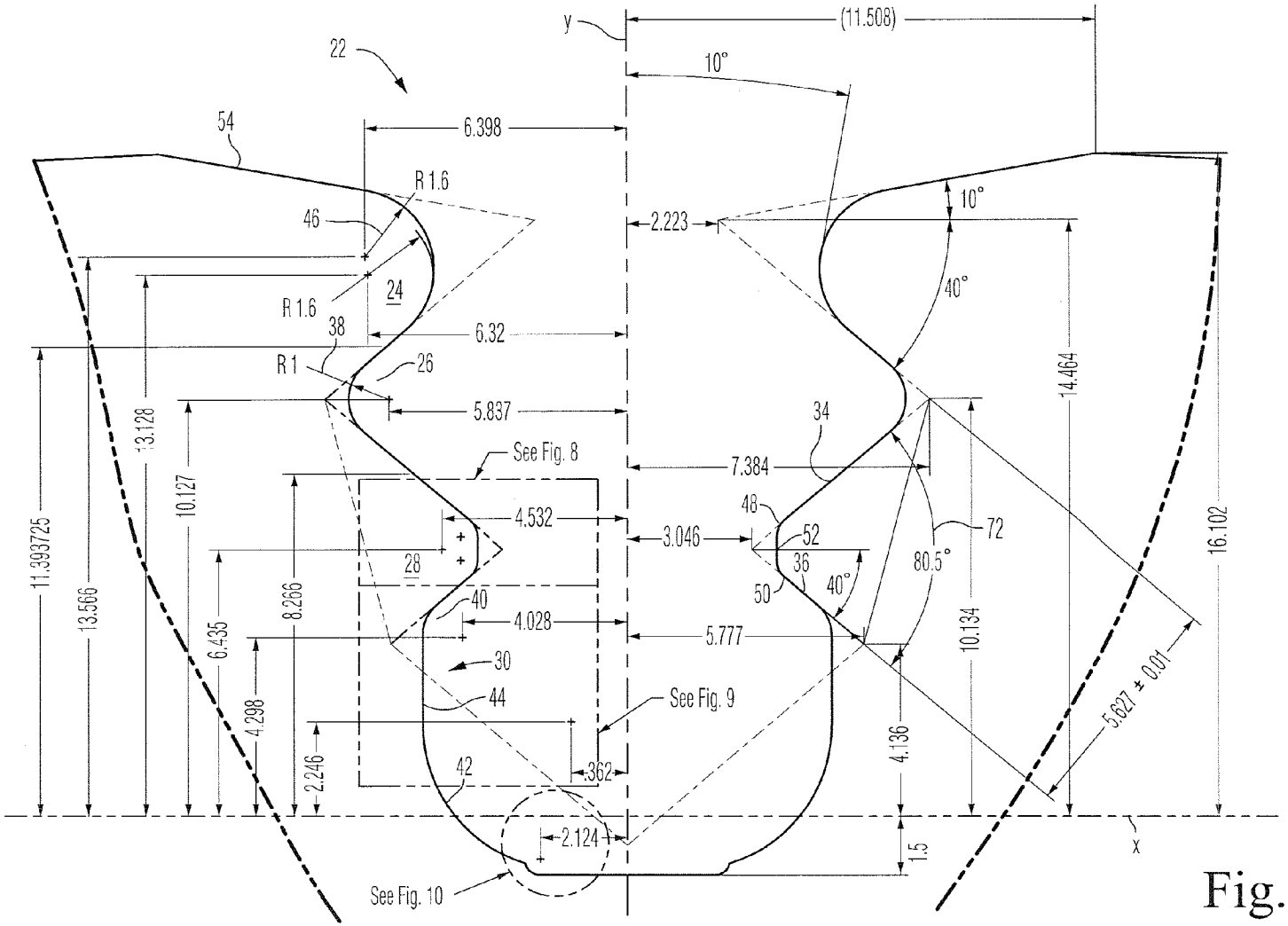
FIG. 4 is a detailed side view of the rotor, including the slot, or rotor dovetail

Referring to FIGS. 4 and 5, a slant angle 72 is provided between the non-contact surface 34 of the rotor dovetail 22 and the bottom slanted crush surface 36 of the rotor dovetail 22. The slant angle 72 is also provided between the non-contact surface 16 of the bucket dovetail 4 and the bottom slanted crush surface 18 of the bucket dovetail 4. The crush surfaces 18 and 36 are rotated, or oriented, such that the transition angle between the crush surfaces 18 and 36 and the non-contact surfaces 16 and 34, respectively, is about 80.5°. The slant angle 72 is also generally substantially symmetrical about an axis X that is perpendicular to the dovetail centerline Y. The bottom dovetail neck 10 of the bucket dovetail 4 is formed between the non-contact surface 16 and the bottom slanted crush surface 18. The bottom hook 28 is formed between the non-contact surface 34 of the rotor dovetail 20 and the bottom slanted crush surface 36 of the rotor dovetail 20.

Concentrated stresses result when load paths are forced to change direction. By providing the slanted crush surfaces, the change in direction is less severe and the stress concentration is lower. The slanted crush surfaces also permit a larger fillet radius in the transition distance between the crush surface and the non-contact surface. The larger fillet radius also results in a lower concentrated stress, while increasing the crush contact area.

The hook thickness and neck length controls the load sharing between the hooks as well as the bending and shear stiffness/stresses in the hook. All of this contributes to the degree of concentrated stress and strain. Therefore, the hook thicknesses and the neck lengths are optimized to minimize local and average stresses. As shown in the drawing figures, the hook thickness is the difference between the dimensions from the X axis along the dovetail centerline Y. For example, the top hook 24 has a thickness of 14.665−6.587=8.078.

As described herein, the location of the radii, the values of the radii, and the other aspects of the shape of the bucket dovetail and rotor dovetail, including, but not limited to, the hook thicknesses and neck lengths, are optimized to minimize the local and average stresses. As shown in the drawing figures, the values of the location of the radii, the values of the radii, the hook thicknesses and neck lengths are basic dimensions, it being understood that the bucket dovetail and rotor dovetail may be scaled to greater or lesser sizes provided that the shapes remain the same. The values shown in the drawing figures may thus be considered non-dimensional.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A blade mountable to a disc, the blade comprising:

a blade platform; and a blade root extending from the blade platform, the blade root comprising a first hook and a second hook, a first neck between the first hook and the blade platform, and a second neck between the first hook and the second hook, wherein each hook comprises a contact surface and a non-contact surface and an angle between the non-contact surface of the first hook and the contact surface of the second hook is optimized to reduce local stresses and the angle is substantially symmetrical about an axis perpendicular to a centerline of the blade root.

2. A blade according to claim 1, wherein each of the first and second hooks comprises fillets, each fillet comprises a first radius and a second radius, and the fillets are joined by a flat surface.

3. A blade according to claim 2, wherein one of the radii of the second hook is a compound radius.

4. A blade according to claim 1, wherein the first neck comprises a first radius and the second neck comprises a second radius, and the first radius is larger than the second radius.

5. A blade according to claim 1, wherein at least one of thicknesses of the hooks and lengths of the necks is optimized to minimize local and average stresses.

6. A blade mountable to a disc, the blade comprising:

a blade platform; and a blade root extending from the blade platform, the blade root comprising a first hook and a second hook, a first neck between the first hook and the blade platform, and a second neck between the first hook and the second hook, wherein each hook comprises a contact surface and a non-contact surface and an angle between the non-contact surface of the first hook and each the contact surface of the second hook is about 80.5° and the angle is substantially symmetrical about an axis perpendicular to a centerline of the blade root.

7. A blade according to claim 6, wherein each of the first and second hooks comprises fillets, each fillet comprises a first radius and a second radius, and the fillets are joined by a flat surface.

8. A blade according to claim 7, wherein one of the radii of the second hook is a compound radius.

9. A blade according to claim 6, wherein the first neck comprises a first radius and the second neck comprises a second radius, and the first radius is larger than the second radius.

10. A blade according to claim 6, wherein at least one of thicknesses of the hooks and lengths of the necks is optimized to minimize local and average stresses.

11. A turbine, comprising:

a turbine blade, the turbine blade comprising a blade platform and a blade root extending from the blade platform, the blade root comprising a first blade hook and a second blade hook, a first blade neck between the first blade hook and the blade platform, and a second blade neck between the first blade hook and the second blade hook, wherein each blade hook comprises a contact surface, a non-contact surface, and an angle between the non-contact surface of the first hook and the contact surface of the second hook;

a rotor disc comprising a slot, the slot comprising a first rotor hook and a second rotor hook, a first rotor neck and a second rotor neck, wherein each rotor hook comprises a contact surface in contact with a corresponding contact surface of the blade and a non-contact surface spaced from a corresponding non-contact surface of the blade, wherein the rotor contact surfaces are angled from the rotor non-contact surfaces at the same angle as the angle between the blade contact surfaces and the blade non-contact surfaces, and the angle is optimized to reduce local and average stresses between the contact surfaces and the angle is substantially symmetrical about an axis perpendicular to a centerline of the blade root.

12. A turbine according to claim 11, wherein the first rotor neck comprises a first radius.

13. A turbine according to claim 11, wherein the second rotor neck comprises a first radius and a second radius joined by a flat surface.

14. A turbine according to claim 11, wherein the first rotor hook comprises a first radius, the second rotor hook comprises fillets, each fillet comprises a second radius and a third radius, the fillets are joined by a flat surface, and the first radius is larger than the second radius and third radius.

15. A turbine according to claim 11, wherein at least one of thicknesses of the blade hooks and rotor hooks and lengths of the blade necks and rotor necks are optimized to reduce local and average stresses at the contact surfaces.

16. A turbine according to claim 11, wherein the angle is about 80.5°.

* * * * *